US009838789B2

(12) United States Patent
Merz

(10) Patent No.: US 9,838,789 B2
(45) Date of Patent: Dec. 5, 2017

(54) HONEYCOMB SPEAKER SYSTEM

(71) Applicant: Robert Merz, Haddon Township, NJ (US)

(72) Inventor: Robert Merz, Haddon Township, NJ (US)

( * ) Notice: Subject to any disclaimer, the term of this patent is extended or adjusted under 35 U.S.C. 154(b) by 0 days.

(21) Appl. No.: 14/867,028

(22) Filed: Sep. 28, 2015

(65) Prior Publication Data

US 2016/0127831 A1 May 5, 2016

Related U.S. Application Data

(60) Provisional application No. 62/056,527, filed on Sep. 27, 2014.

(51) Int. Cl.

| | |
|---|---|
| ***H04R 1/02*** | (2006.01) |
| ***H04R 5/02*** | (2006.01) |
| *H04R 1/28* | (2006.01) |
| *H04R 1/26* | (2006.01) |

(52) U.S. Cl.

CPC ..... *H04R 5/02* (2013.01); *H04R 1/02* (2013.01); *H04R 1/26* (2013.01); *H04R 1/2873* (2013.01); *H04R 1/2892* (2013.01); *H04R 1/2896* (2013.01); *H04R 2205/022* (2013.01)

(58) Field of Classification Search

CPC ..... H04R 1/02; H04R 1/26; H04R 1/2873; H04R 1/2811; H04R 1/2892; H04R 1/2896; H04R 2205/022; H04R 2205/026; H04R 2205/024

USPC ..... 381/334–336, 386

See application file for complete search history.

(56) References Cited

U.S. PATENT DOCUMENTS

| | | | | |
|---|---|---|---|---|
| 2,544,742 A | | 3/1951 | Volf | |
| 3,326,321 A | * | 6/1967 | Valuch | H04R 1/345 181/144 |
| 3,818,138 A | | 6/1974 | Sperrazzo | |
| 4,006,308 A | | 2/1977 | Ponsgen | |
| 4,051,919 A | | 10/1977 | Buettner | |
| 4,249,037 A | * | 2/1981 | Dexter | H04R 1/02 181/144 |
| 4,420,061 A | | 12/1983 | Levy | |
| 4,730,694 A | | 3/1988 | Albarino | |
| 5,123,500 A | | 6/1992 | Malhoit | |
| 5,227,591 A | | 7/1993 | Tarkkonen | |
| 5,436,976 A | | 7/1995 | Dougherty | |
| 5,513,270 A | | 4/1996 | Lewis | |

(Continued)

FOREIGN PATENT DOCUMENTS

EP 0604450 B1 6/1994

OTHER PUBLICATIONS

Olson, Harry F, Direct Radiator Loudspeaker Enclosures, Audio Engineering, vol. 35:11, Nov. 1951.

*Primary Examiner* — Disler Paul
(74) *Attorney, Agent, or Firm* — Muskin and Farmer LLC

(57) ABSTRACT

A hexagonal speaker with six edges (sides) and four drivers. A pair of drivers is embedded on adjacent edges and another pair of drivers is embedded on the opposite edges, while two opposing edges in between each pair of drivers do not have a driver. A down-firing subwoofer is located on the bottom of the speaker. The speaker is raised off the ground so that the subwoofer can output sound without touching the ground. An air vent tube is also located on the bottom of the speaker adjacent to the subwoofer.

20 Claims, 3 Drawing Sheets

(56) References Cited

U.S. PATENT DOCUMENTS

| | | | | |
|---|---|---|---|---|
| 6,431,308 | B1 | 8/2002 | Vollmer | |
| 6,625,289 | B1 | 9/2003 | Oliemuller | |
| 8,175,304 | B1 | 5/2012 | North | |
| 8,223,995 | B1 * | 7/2012 | Esposito | G10H 3/186 381/120 |
| 2014/0219491 | A1 | 8/2014 | Ludlum | |

* cited by examiner

FIG. 2A
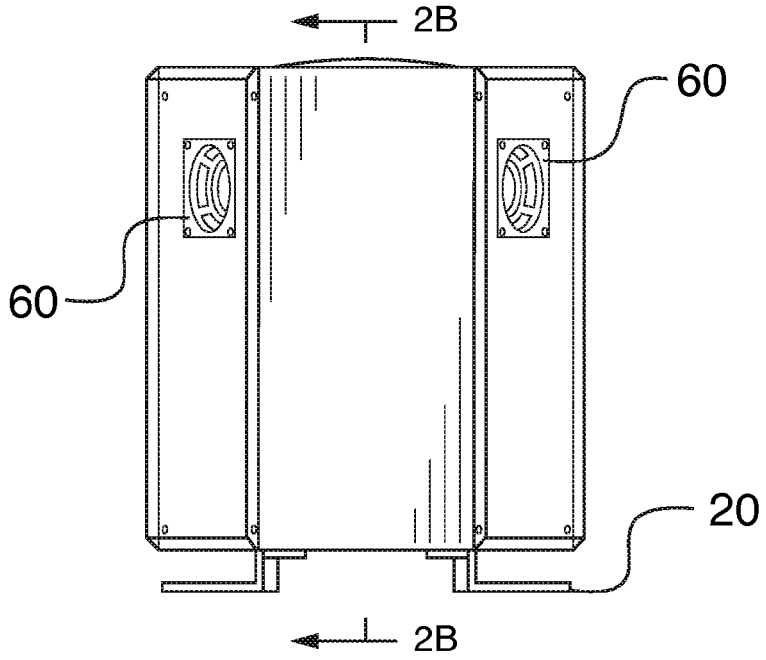
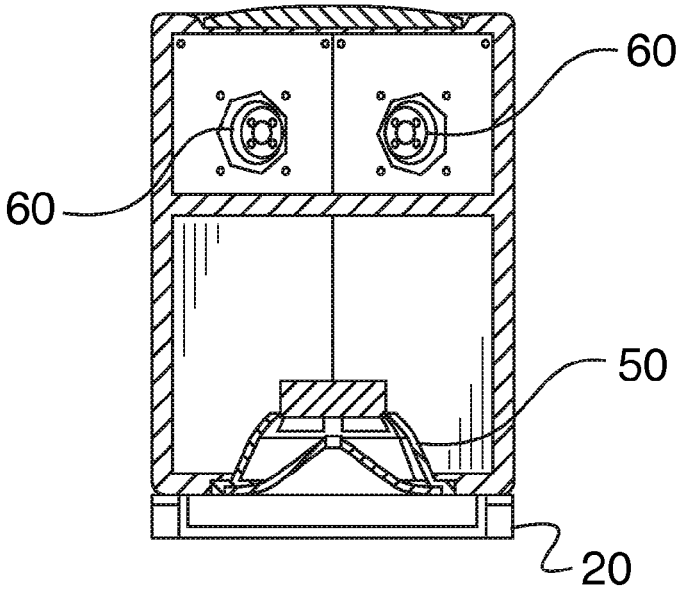
FIG. 2B

FIG. 2C
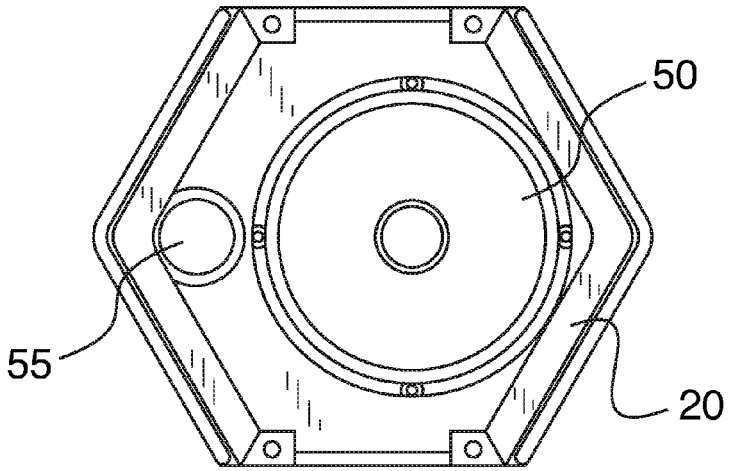
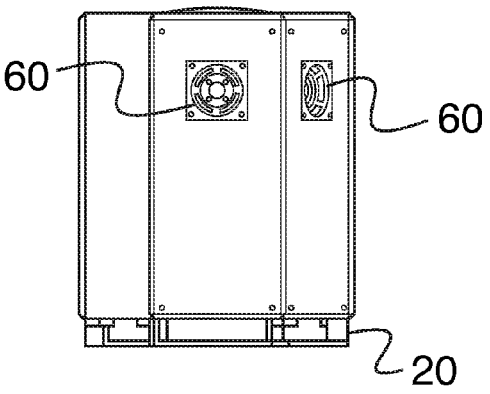
FIG. 2D
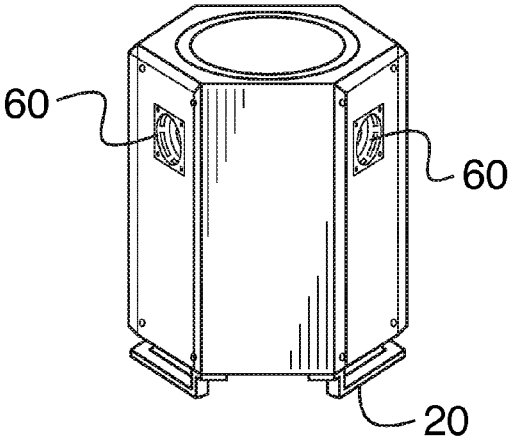
FIG. 2E

HONEYCOMB SPEAKER SYSTEM

CROSS REFERENCE TO RELATED APPLICATIONS

This application claims benefit to U.S. provisional application 62/056,527, filed on Sep. 27, 2014, which is incorporated by reference herein in its entirety.

BACKGROUND OF THE INVENTION

Field of the Invention

The present general inventive concept is directed to a loudspeaker system.

Description of the Related Art

Loudspeakers are well known devices which are designed to convert electrical energy signals into corresponding acoustical energy sound waves. Such loudspeakers typically include a closed box-shaped housing or similar enclosure having one or more individual speakers mounted on an edge thereof. The speakers face outwardly from the enclosure such that the sound waves are emitted forwardly therefrom. When more than one speaker is provided on the enclosure, an electronic cross over circuit is usually provided to divide the electrical signals. The nature of the sounds generated by the loudspeaker is dependent upon many factors, including the size and shape of the enclosure, the size and number of speakers mounted within the enclosure, and the electronic cross over circuit.

Speaker enclosures have been generally constructed with rectangular planer sidewalls and have had a rectangular or square horizontal cross section. As the loudspeaker system contained therein moves to produce the sound, these structures are characterized by vibration and standing waves as well as diffracted waves caused by sharp boundaries of the sidewalls of the enclosure which lessens the quality of the sound response.

One drawback with current stereo loudspeaker arrangements is that the created stereophonic effect hardly gives an impression of a depth-expanded sound. The sound field seems to come flat out of the wall.

In the field of sound reproduction, it is desirable to have a loudspeaker system that exists as a stand alone or single device or unit, such that it can be readily set up, moved, or transported, and where the design and placement of the speakers is optimized to attain high quality sound reproduction.

In a system of two loudspeakers (with or without a separated dedicated subwoofer), it is to some degree possible to create a depth extension of the sound field (particularly within the medium level of the loudspeakers) but the impression of the space of the performance remains inadequate.

What is needed is a speaker system which can achieve high power, low distortion in a compact package.

SUMMARY OF THE INVENTION

It is an aspect of the present invention to provide an improved loudspeaker system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 2A is a drawing of a front view of an exterior of the honeycomb speaker, according to an embodiment;

FIG. 2B is a drawing of a cross section of the honeycomb speaker showing the subwoofer on the bottom, according to an embodiment;

FIG. 2C is a drawing of a bottom view of an exterior of the honeycomb speaker, according to an embodiment;

FIG. 2D is a drawing of a side view of an exterior of the honeycomb speaker, according to an embodiment; and FIG. 2E is a drawing of an isometric view of the honeycomb speaker, according to an embodiment.

DESCRIPTION OF THE PREFERRED EMBODIMENTS

Figure 1:
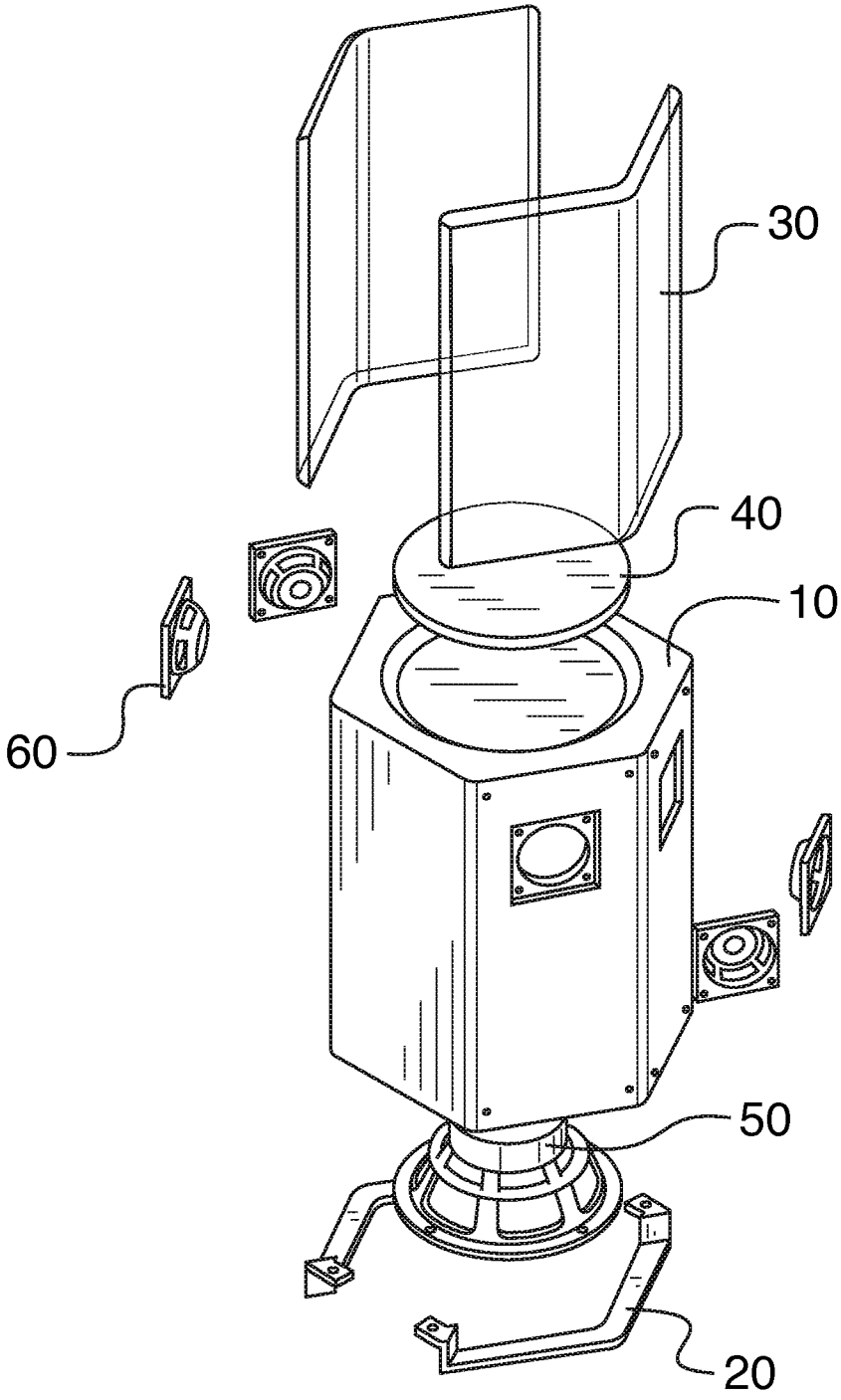
FIG. 1 is a drawing showing components of a honeycomb speaker in a disassembled state, according to an embodiment.

Reference will now be made in detail to the presently preferred embodiments of the invention, examples of which are illustrated in the accompanying drawings, wherein like reference numerals refer to like elements throughout.

The present inventive concept relates to a speaker enclosure 10 configured in a honeycomb shape, with six edges/sides. Four of the sides (edges) have a driver 60 embedded in them and two of the edges do not have a driver. The speaker is configured as two adjacent drivers 60, then an edge without a driver then two more adjacent drivers 60, then another edge without a driver. A subwoofer 50 is located on the bottom of the speaker and a stand 20 (can be made out of aluminum) attaches onto the bottom of the speaker to raise the speaker off the ground to give the subwoofer 50 some room. The sound waves generated by the downwardly facing subwoofer 50 are emitted through the open space around the enclosure. Because of the relative positions the drivers 60 face, the honeycomb shaped speaker can provide a full 360 cover of sound.

The speaker system adopts a hexagonal (honeycomb) shape as an enclosure 10 for its downward-firing subwoofer 50; two speakers 60 at the front edges, and two speakers 60 on the rear edges. Honeycomb structures form a perfect geometry allowing for a minimum amount of material in relation to weight and cost. There is also a high strength to weight ratio. The front edge houses an LED display and onboard controls in sync with the remote control, while the rear edge allows for inputs to TV, DVD, video games, and mp3 music.

The loudspeaker elements 60 of the left-hand channel and the right-hand channel in the loudspeaker system are combined within the same loudspeaker unit. The loudspeaker elements 60 are arranged to radiate towards different edges in a similar fashion, in which case the sounds reflected from the surfaces, together with the sounds coming directly from the loudspeaker unit, create a depth expanded, three-dimensional stereo sound effect. By employing only one loudspeaker unit, it creates a stereophonic, depth-expanded impression of the original space of performance. Thus the impression that the listener receives of a musical performance or the like comes close to the real impression experienced by the listeners present at the original performance.

Since higher audible frequencies travel in a straight line and do not have the capability to bend around objects in their path, it is important to raise high frequency (full range) drivers 60 closer to ear level and position at the upper part of the enclosure 10. Therefore, a plurality of speakers 60 should be mounted in the upper half of the speaker enclosure 10.

Speaker drivers 60 should be spaced at equidistant intervals along the circumference of the sidewall. This increases stability of the direction of the emanating sound. Since direct sound is received a fraction of a second earlier than indirect sound, the omnidirectional speakers maintain directional clues while providing the listener with a broad sound source. The drivers 60 can be arranged in a 360 degree surround sound array.

Further, utilizing the four speakers 60 (drivers) improves speaker capability and produces a superior transient response. Transient response of a speaker is inversely related to the moving mass of the speaker. To improve transient response, decreasing the physical size of the cone reduces the moving mass of the speaker. However, reduction in cone size decreases power output capability in low frequency response. Therefore, by utilizing a plurality of smaller speaker elements 60, power output capability is maintained and transient response is improved.

By utilizing full range speaker drivers 60, the need for cross-over networks to differentiate between high and low frequency signals are eliminated. When utilizing cross over networks, problems may be present, primarily at the cross over frequency. For example, when operating at the cross over frequency, power capability is usually reduced to approximately one-half of the total available power. In addition, transient distortion is usually present at or near the cross over frequency due to the sharp attenuation rate in the network.

Wherein high frequency speakers 60 are utilized along with a low frequency speaker 50, the utilization of this combination of loudspeakers 60, 50 can create a greater degree of efficiency and sound reproduction by reducing intermodulation distortion and providing more reserve power handling capabilities. In addition, it permits adjustment of sound levels, thereby creating a more balanced sound output.

FIG. 1 is a drawing showing components of a honeycomb speaker in a disassembled state, according to an embodiment.

A speaker has a baffle 10, aluminum footing 20, grilles 30 (with cloth cover), and a decorative plastic insert 40. The speaker also has 6.5 inch downfiring subwoofer 50, and four 2.5 inch drivers 60. Note that a pair of drivers 60 are on adjacent edges of the hexagon and another pair of drivers 60 are on opposite edges of the hexagon. The speaker is raised off the ground via aluminum footing 20 (also referred to as stand/base) so that the downfiring subwoofer 50 has room off the floor for its sound to spread out in all directions, complementing the sound being spread out in all directions from the four drivers 60.

The drivers 60 and their firing axis/angle relative to the front and rear are shown in FIG. 1. The drivers reproduce sound at 360 degrees. The sound pressure radiated from the drivers 60 is angled and dispersed in such a way so as to transmit wide dispersion patterns at angles away from one another. As the sound pressure travels farther away from the loudspeaker cones of the drivers 60, the dispersion is widened resulting in both near field and long field pattern control, and resulting in sound being dispersed at 360 degrees. The drivers 60 are set at an outwardly facing angle as illustrated.

FIG. 2A is a drawing of a front view of an exterior of the honeycomb speaker, according to an embodiment. Two drivers 60 are shown in this view with an edge between them without a driver.

FIG. 2B is a drawing of a cross section of the honeycomb speaker showing the subwoofer 50 on the bottom, according to an embodiment. Two drivers 60 are shown in this view on adjacent edges. Note that drivers 60 are on the upper section of the speaker. The subwoofer 50 is positioned on the bottom.

FIG. 2C is a drawing of a bottom view of an exterior of the honeycomb speaker, according to an embodiment. The subwoofer 50 is adjacent to an air vent tube 55. Also shown is an aluminum base 20 which raises the honeycomb speaker off the ground thereby giving the subwoofer some room so it doesn't touch the floor.

FIG. 2D is a drawing of a side view of an exterior of the honeycomb speaker, according to an embodiment. Two adjacent drivers 60 are shown.

FIG. 2E is a drawing of an isometric view of the honeycomb speaker, according to an embodiment. The decorative panel 40 is shown in top.

The sound system is designed as a one-piece, AC (plug-in) powered, 2.1 channel, plug-n-play, transportable stereo speaker system (6½" subwoofer 50; 2½" full-range speaker 60×2 per channel) with Bluetooth® wireless capability.

The speaker system has a six-sided hexagonal (irregular) shape enclosure 10, 2.1 channel amplification with 6½" powered subwoofer 50 (downward-firing), and a four full-range speaker 60 array. The honeycomb shape (6 sided) provides structural integrity and reduced diffraction. The speaker enclosure 10 can be 12 inches wide by 10.5 inches deep by 14 to 16 inches height (without a base), but of course the speaker enclosure 10 can be made using other dimensions as well. The height can increase to 16 inches to accommodate an amplifier. The front and rear edges can measure 6 inches in length while the side edges can measure 4⅝ inches. The drivers 60 (2 each on the front-side edges and back-side edges) can be 2.5 inches. The subwoofer 50 can be 6.5 inches (downward firing). In an embodiment, the speaker enclosure 10 can be made from medium density fiberboard (should be 18 millimeters thick) with wood veneer finish and a metal support stand 20. It can also utilize a 2.1 channel amplifier, stereo BLUETOOTH remote control and can have an LED indicator display.

The honeycomb design provides a 360 degree sound field. The speaker system can be positioned as a floor-standing unit. The unit can generate an exceptional dynamic range, deep clean bass, and a wide sound stage. The speaker system also has multiple inputs for mp3 music players, DVD's, TV's, gaming consoles, PC's; or wireless functionality via Bluetooth® to connect to smart phones, laptops, and tablets. The hexagonal (six-sided) design configuration can provide wide-dispersion patterns and true stereo surround-sound capabilities. The speaker system has a downward firing 6.5 inch subwoofer 50 and a four speaker driver 60 surround array.

The subwoofer 50 utilizes a honeycomb cone with paper skin. The 2.5 inch drivers 60 (speakers) use eco-friendly composite paper pulp. The sound waves generated from the subwoofer 50 are directed downward and are emitted through the open space provided between the lower edges of the side edges and the bottom base 20. The loudspeaker functions in this manner to minimize the effects of back wave generation within.

The speaker system has a small footprint and a recessed handle, making it easy to transport. The speaker system can have a 2.1 channel 50-watt digital amplifier which provides ample power sources to both the subwoofer 50 and the full range drivers 60. Other technologies such as DOLBY DIGITAL and BLUETOOTH processing are also incorporated into the speaker. DOLBY DIGITAL is an advanced encoding/decoding audio system that is the industry standard in terms of creating a multi-channel cinematic experience of impact and realism. The Bluetooth processor provides quality wireless without compromising audio quality. It is easy to communicate with the speaker via BLUETOOTH using devices such as a smartphone, tablet, or laptop.

The speaker system also has cloth grilles 30 (2 panels): an LED front edge display for remote control operation via wireless Remote: a 2.1 channel digital amplifier with DOLBY DIGITAL Processing; BLUETOOTH wireless technology; Virtual Surround Sound Mode & Separate Bass/Treble Controls; 6½" Downward-Firing subwoofer 50; four—2½" full-range speakers 60 in 360 degree surround configuration; 50 watts power (approx.)—20 w×1 (subwoofer) and 15 w×2 (full range speaker 60); inputs for optical digital, coaxial digital, aux in (analog), 3.5 mm; and remote control (functions—source, volume, bass/treble, surround).

Benefits of the honeycomb speaker system described herein are that the non-rectangular shape of the speaker is inherently anti-resonant. The baffle's projection and angled edges greatly reduce diffraction, while enhancing the stereo effect, permitting full stereo enjoyment even when the listener is sitting off axis from the enclosure. Other benefits include improved low frequency performance, spatial imaging, high sensitivity, and clarity.

The speaker is a "2.1" system because the drivers 60 reproduce the left sound channel and the right sound channel at higher frequencies, and down firing subwoofer 50 reproduces a combination of the left and right sound channels, at lower frequencies.

It is noted that all of the sizes/measurements of the speaker and its components described herein can be varied and the invention is not limited to the particular sizes/measurements described herein.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A loudspeaker system, comprising:
an enclosure with six edges in a hexagonal shape;
a first driver in and aligned with a first edge out of the six edges;
a second driver in and aligned with a second edge out of the six edges, the second edge being adjacent to the first edge;
a third driver in and aligned with a third edge out of the six edges, the third edge being opposite to the first edge; and
a fourth driver in and aligned with a fourth edge out of the six edges, the fourth edge being opposite to the second edge;
a subwoofer on a bottom of the enclosure;
a footing on the bottom of the enclosure configured to raise the enclosure higher than a floor level;
a fifth edge out of the six edges without a driver; and
a sixth edge out of the six edges without a driver.

2. The loudspeaker system as recited in claim 1, further comprising an air vent tube on the bottom of the enclosure adjacent to the subwoofer.

3. The loudspeaker system as recited in claim 1, wherein the first driver, second driver, third driver, and fourth driver are all located in an upper section of their respective edges.

4. The loudspeaker system as recited in claim 1, wherein the subwoofer is down-firing.

5. The loudspeaker system as recited in claim 1, wherein the hexagonal shape of the enclosure is irregular.

6. The loudspeaker system as recited in claim 1, wherein the first driver, second driver, third driver, and fourth driver are in a 360 degree surround configuration.

7. The loudspeaker system as recited in claim 1, wherein the loudspeaker is configured to provide stereo sound.

8. A loudspeaker system, comprising:
an enclosure with six edges in a hexagonal shape;
a first driver in and aligned with a first edge out of the six edges;
a second driver in and aligned with a second edge out of the six edges, the second edge being adjacent to the first edge;
a third driver in and aligned with a third edge out of the six edges, the third edge being opposite to the first edge; and
a fourth driver in and aligned with a fourth edge out of the six edges, the fourth edge being opposite to the second edge;
a subwoofer on a bottom of the enclosure;
a footing on the bottom of the enclosure configured to raise the enclosure higher than a floor level,
wherein the first driver, second driver, third driver, and fourth driver are all full range speakers.

9. The loudspeaker system as recited in claim 8, further comprising:
a fifth edge out of the six edges without a driver; and
a sixth edge out of the six edges without a driver.

10. A loudspeaker system, comprising:
an enclosure with six edges in a hexagonal shape;
a first driver in a first edge out of the six edges;
a second driver in a second edge out of the six edges, the second edge being adjacent to the first edge;
a third driver in a third edge out of the six edges, the third edge being opposite to the first edge;
a fourth driver in a fourth edge out of the six edges, the fourth edge being opposite to the second edge; a subwoofer on a bottom of the enclosure;
a footing on the bottom of the enclosure configured to raise the enclosure higher than a floor level;
a fifth edge out of the six edges without a driver; and
a sixth edge out of the six edges without a driver.

11. The loudspeaker system as recited in claim 10, further comprising an air vent tube on the bottom of the enclosure adjacent to the subwoofer.

12. The loudspeaker system as recited in claim 10, wherein the first driver, second driver, third driver, and fourth driver are all located in an upper section of their respective edges.

13. The loudspeaker system as recited in claim 10, wherein the subwoofer is down-firing.

14. The loudspeaker system as recited in claim 10, wherein the hexagonal shape of the enclosure is irregular.

15. The loudspeaker system as recited in claim 10, wherein the first driver, second driver, third driver, and fourth driver are all full range speakers.

16. A loudspeaker system, comprising:

an enclosure with six edges in a hexagonal shape;

a first driver in a first edge out of the six edges;

a second driver in a second edge out of the six edges, the second edge being adjacent to the first edge;

a third driver in a third edge out of the six edges, the third edge being opposite to the first edge;

a fourth driver in a fourth edge out of the six edges, the fourth edge being opposite to the second edge; a subwoofer on a bottom of the enclosure; and a footing on the bottom of the enclosure configured to raise the enclosure higher than a floor level, wherein the first driver, second driver, third driver, and fourth driver are all full range speakers.

17. The loudspeaker system as recited in claim 16, further comprising an air vent tube on the bottom of the enclosure adjacent to the subwoofer.

18. The loudspeaker system as recited in claim 16, wherein the first driver, second driver, third driver, and fourth driver are all located in an upper section of their respective edges.

19. The loudspeaker system as recited in claim 16, wherein the hexagonal shape of the enclosure is irregular.

20. The loudspeaker system as recited in claim 16, further comprising:

a fifth edge out of the six edges without a driver; and a sixth edge out of the six edges without a driver.

* * * * *